US006902867B2

(12) United States Patent
Hall et al.

(10) Patent No.: US 6,902,867 B2
(45) **Date of Patent: *Jun. 7, 2005**

(54) INK JET PRINTHEADS AND METHODS THEREFOR

(75) Inventors: Eric Spencer Hall, Lexington, KY (US); Shauna Marie Leis, Georgetown, KY (US); Andrew Lee McNees, Lexington, KY (US); James Michael Mrvos, Lexington, KY (US); James Harold Powers, Lexington, KY (US); Carl Edmond Sullivan, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 142 days.

This patent is subject to a terminal disclaimer.

(21) Appl. No.: 10/262,827

(22) Filed: Oct. 2, 2002

(65) Prior Publication Data

US 2004/0067446 A1 Apr. 8, 2004

(51) Int. Cl.[7] ..... B41J 2/05

(52) U.S. Cl. ..... 430/311; 430/312; 430/313; 430/316; 430/317; 430/318; 430/319; 430/320; 216/27; 347/63

(58) Field of Search ..... 430/311, 312, 430/316, 317, 318, 319, 320; 216/27; 347/63

(56) References Cited

U.S. PATENT DOCUMENTS

| | | | | |
|---|---|---|---|---|
| 3,756,875 A | | 9/1973 | Eccleston et al. | |
| 4,059,480 A | * | 11/1977 | Ruh et al. | 438/701 |
| 4,234,362 A | | 11/1980 | Riseman | |
| 4,255,514 A | | 3/1981 | Kane | |
| 4,312,680 A | | 1/1982 | Hsu | |
| 4,319,261 A | | 3/1982 | Kub | |
| 4,322,883 A | | 4/1982 | Abbas et al. | |
| 4,329,706 A | | 5/1982 | Crowder et al. | |
| 4,374,700 A | | 2/1983 | Scott et al. | |
| 4,378,627 A | | 4/1983 | Jambotkar | |

(Continued)

FOREIGN PATENT DOCUMENTS

| | | |
|---|---|---|
| DE | 19847455 | 4/2000 |
| EP | 0 227 303 A2 | 1/1987 |

(Continued)

OTHER PUBLICATIONS

DE 19847455 Silicon multi–layer etching, especially for micromechanical sensor production, comprises etching trenches down to buried separation layer, etching exposed separation layer and etching underlying silicon layer (Abstract Only).

(Continued)

*Primary Examiner*—Barbara L. Gilliam
(74) *Attorney, Agent, or Firm*—Luedeka, Neely & Graham, P. C.

(57) ABSTRACT

The invention provides a method for making ink feed vias in semiconductor silicon substrate chips for an ink jet printhead and ink jet printheads containing silicon chips made by the method. The method includes applying a first photoresist material to a first surface side of the chip. The first photoresist material is patterned and developed to define at least one ink via location therein. An etch stop material is applied to a second surface side of the chip. At least one ink via is anisotropically etched with a dry etch process through the thickness of the silicon chip up to the etch stop layer from the first surface side of the chip. As opposed to conventional ink via formation techniques, the method significantly improves the throughput of silicon chip and reduces losses due to chip breakage and cracking. The resulting chips are more reliable for long term printhead use.

29 Claims, 7 Drawing Sheets

U.S. PATENT DOCUMENTS

| | | | |
|---|---|---|---|
| 4,406,051 | A | 9/1983 | Iizuka |
| 4,415,606 | A | 11/1983 | Cynkar et al. |
| 4,419,809 | A | 12/1983 | Riseman et al. |
| 4,448,636 | A | 5/1984 | Baber |
| 4,473,598 | A | 9/1984 | Ephrath et al. |
| 4,478,679 | A | 10/1984 | Chang et al. |
| 4,507,171 | A | 3/1985 | Bhatia et al. |
| 4,507,853 | A | 4/1985 | McDavid |
| 4,518,629 | A | 5/1985 | Jeuch |
| 4,544,445 | A | 10/1985 | Jeuch et al. |
| 4,592,802 | A | 6/1986 | Deleonibus et al. |
| 4,631,248 | A | 12/1986 | Pasch |
| 4,666,737 | A | 5/1987 | Gimpelson et al. |
| 4,679,304 | A | 7/1987 | Bois |
| 4,691,435 | A | 9/1987 | Anantha et al. |
| 4,693,781 | A | 9/1987 | Leung et al. |
| 4,807,013 | A | 2/1989 | Manocha |
| 4,822,755 | A | 4/1989 | Hawkins et al. |
| 4,835,115 | A | 5/1989 | Eklund |
| 4,863,560 | A | 9/1989 | Hawkins |
| 4,916,086 | A | 4/1990 | Takahashi et al. |
| 5,106,777 | A | 4/1992 | Rodder |
| 5,130,268 | A | 7/1992 | Liou et al. |
| 5,317,346 | A | 5/1994 | Garcia |
| 5,468,676 | A | 11/1995 | Madan |
| 5,501,893 | A | 3/1996 | Laermer et al. |
| 5,658,471 | A | 8/1997 | Murthy et al. |
| 5,674,775 | A | 10/1997 | Ho et al. |
| 5,719,085 | A | 2/1998 | Moon et al. |
| 5,731,221 | A | 3/1998 | Kwon |
| 5,773,343 | A | 6/1998 | Lee et al. |
| 5,801,083 | A | 9/1998 | Yu et al. |
| 5,804,083 | A | 9/1998 | Ishii et al. |
| 5,811,346 | A | 9/1998 | Sur et al. |
| 5,920,787 | A | 7/1999 | Haskell et al. |
| 5,989,445 | A | 11/1999 | Wise et al. |
| 6,000,787 | A | 12/1999 | Weber et al. |
| 6,045,218 | A | 4/2000 | Tajima et al. |
| 6,051,503 | A | 4/2000 | Bhardwaj et al. |
| 6,096,656 | A | 8/2000 | Matzke et al. |
| 6,107,158 | A | 8/2000 | Zheng et al. |
| 6,107,661 | A | 8/2000 | Okabe et al. |
| 6,171,510 | B1 | 1/2001 | Lee |
| 6,322,198 | B1 | 11/2001 | Higashino et al. |
| 6,331,259 | B1 | 12/2001 | Ozaki et al. |
| 6,555,480 | B2 | 4/2003 | Milligan et al. |
| 2001/0020965 | A1 | 9/2001 | Fujii et al. |
| 2001/0028378 | A1 | 10/2001 | Lee et al. |
| 2001/0040596 | A1 | 11/2001 | Lee et al. |
| 2001/0055048 | A1 | 12/2001 | Lee et al. |
| 2002/0012026 | A1 | 1/2002 | Kubota et al. |
| 2002/0195420 | A1 | 12/2002 | Obert et al. |

FOREIGN PATENT DOCUMENTS

| | | |
|---|---|---|
| EP | 227303 | 7/1987 |
| EP | 338207 | 10/1989 |
| EP | 0 338 207 A1 | 6/1993 |
| EP | 0 549 199 A2 | 6/1993 |
| EP | 549199 | 6/1993 |
| EP | 0 603 106 A2 | 6/1994 |
| EP | 603106 | 6/1994 |
| EP | 985534 | 3/2000 |
| EP | 0 985 534 A1 | 3/2000 |
| EP | 1270233 A1 | 2/2003 |
| GB | 2194858 A | 3/1988 |
| GB | 2194858 | 3/1988 |
| JP | 57186339 | 11/1982 |
| JP | 58168261 | 10/1983 |
| WO | WO 00/00354 | 1/2000 |
| WO | WO 00/26956 | 5/2000 |
| WO | WO 00/79343 A1 | 12/2000 |
| WO | WO 00/79343 | 12/2000 |
| WO | WO 01/94117 | 12/2001 |
| WO | WO 01/94117 A1 | 12/2001 |

OTHER PUBLICATIONS

JP 56–087666—Plasma Etching Method Published Jul. 16, 1981 (abstract only).

JP 57–186339—Etching Method for Silicon Published Nov. 16, 1982 (abstract only).

JP 58–168261—Manufacture of Semiconductor Device Published Oct. 4, 1983 (abstract only).

JP 59–057449—Semiconductor Device and Its Manufacture Published Apr. 3, 1984 (abstract Only).

"A High Resolution, Electrostatically Driven Commercial Inkjet Head", S. Kamisuki et al., 5 pages, Jan. 27, 2000.

"Dry Silicon Etching For MEMS," J. Bhardwaj et al., Electrochemical Society Proceedings vol. 97–5, pp. 118–130 May 4–9, 1997.

"5×5 2D AFM Cantilever Arrays a First Step Towards a Terabit Storage Device," M. Lutwyche et al, pp. 89–94, 1999 Elsevier Science S.A.

"Characterization of a Time Multiplexed Inductively Coupled Plasma Etcher," Ayon et al., Journal of the Electrochemical Society, 146 (1), pp. 339–349, 1999.

STS Technical Presentation, California, 1997.

"Micromachining of Buried Micro Channels in Silicon," M. J. de Boer, et al., Journal of Microelectromechanical Systems, vol. 9, No. 1, Mar. 2000, pp. 94–103.

"Silicon Micromachining," M. Elwenspoek et al., Cambridge University Press, 1998, pp. 296–297 and 304–308.

* cited by examiner 118
110
114

118
110
114
112

118
110
114
112
116

120
112
116
118
114

120
112
122
124
118
110
114

114
122
118
110

INK JET PRINTHEADS AND METHODS THEREFOR

This application is related to U.S. Pat. No. 6,402,301, issued Jun. 11, 2002, entitled "INK JET PRINTHEADS AND METHODS THEREFOR." This application and the '301 patent are assigned to a common assignee.

FIELD OF THE INVENTION

The invention is directed to printheads for ink jet printers and more specifically to improved printhead structures and methods for making the structures.

BACKGROUND

Ink jet printers continue to be improved as the technology for making the printheads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or printhead itself. This seemingly simple device is a microscopic marvel containing electrical circuits, ink passageways and a variety of tiny parts assembled with precision to provide a powerful, yet versatile component of the printer. The printhead components must also cooperate with an endless variety of ink formulations to provide the desired print properties. Accordingly, it is important to match the printhead components to the ink and the duty cycle demanded by the printer. Slight variations in production quality can have a tremendous influence on the product yield and resulting printer performance.

An ink jet printhead includes a semiconductor chip and a nozzle plate attached to the chip. The semiconductor chip is typically made of silicon and contains various passivation layers, conductive metal layers, resistive layers, insulative layers and protective layers deposited on a device surface thereof. The individual heater resistors are defined in the resistive layers and each heater resistor corresponds to a nozzle hole in the nozzle plate for heating and ejecting ink toward a print media. In one form of a printhead, the nozzle plates contain ink chambers and ink feed channels for directing ink to each of the heater resistors on the semiconductor chip. In a center feed design, ink is supplied to the ink channels and ink chambers from a slot or single ink via which is conventionally formed by chemically etching or grit blasting through the thickness of the semiconductor chip.

Until now, grit blasting the semiconductor chip to form ink vias was a preferred technique because of the speed with which chips can be made by this technique. However, grit blasting results in a fragile product and often times creates microscopic cracks or fissures in the silicon substrate which eventually lead to chip breakage and/or failure. Furthermore, grit blasting cannot be adapted on an economically viable production basis for forming substantially smaller holes in the silicon substrate or holes having the desired dimensional parameters for the higher resolution printheads. Another disadvantage of grit blasting is the sand and debris generated during the blasting process which is a potential source of contamination and the grit can impinge on electrical components on the chips causing electrical failures.

Wet chemical etching techniques may provide better dimensional control for etching of relatively thin semiconductor chips than grit blasting techniques. However, as the thickness of the wafer approaches 200 microns, tolerance difficulties increase significantly. In wet chemical etching, dimensions of the vias are controlled by a photolithographic masking process. Mask alignment provides the desired dimensional tolerances. The resulting ink vias have smooth edges which are free of cracks or fissures. Hence the chip is less fragile than a chip made by a grit blasting process. However, wet chemical etching is highly dependent on the thickness of the silicon chip and the concentration of the etchant which results in variations in etch rates and etch tolerances. The resulting etch pattern for wet chemical etching must be at least as wide as the thickness of the wafer. Wet chemical etching is also dependent on the silicon crystal orientation and any misalignment relative to the crystal lattice direction can greatly affect dimensional tolerances. Mask alignment errors and crystal lattice registration errors may result in significant total errors in acceptable product tolerances. Wet chemical etching is not practical for relatively thick silicon substrates because the entrance width is equal to the exit width plus the square root of 2 times the substrate thickness when using KOH and (100) silicon. Furthermore, the tolerances required for wet chemical etching are often too great for small or closely spaced holes because there is always some registration error with respect to the lattice orientation resulting in relatively large exit hole tolerances.

As advances are made in print quality and speed, a need arises for an increased number of heater resistors which are more closely spaced on the silicon chips. Decreased spacing between the heater resistors requires more reliable ink feed techniques for the individual heater resistors. Increases in the complexity of the printheads provide a need for long-life printheads which can be produced in high yield while meeting more demanding manufacturing tolerances. Thus, there continues to be a need for improved manufacturing processes and techniques which provide improved printhead components.

SUMMARY OF THE INVENTION

With regard to the above and other objects the invention provides a method for making one or more ink feed vias in semiconductor silicon substrate chips for an ink jet printhead. The method includes the steps of:

- applying a first photoresist material to a first surface side of the chip to provide a masking layer of first photoresist material on the first surface side of the chip, the chip having a thickness ranging from about 300 to about 800 microns;
- patterning and developing the first photoresist material to define at least one ink via location therein;
- applying an etch stop material to a second surface side of the chip to provide an etch stop layer on the second surface side of the chip;
- anisotropically etching at least one ink via through the thickness of the silicon chip up to the etch stop layer from the first surface side of the chip using a dry etch technique whereby a via having substantially vertical side walls is provided through the thickness of the chip;
- removing the first photoresist material on the first surface side of the chip; and
- removing the etch stop material to provide a chip having at least one ink via therethrough.

In another aspect the invention provides a method for making one or more ink feed vias in a semiconductor silicon substrate chip for an ink jet printhead. The chip has a thickness ranging from about 300 to about 800 microns, a device surface side and an ink surface side opposite the device surface side. The method includes the steps of:

applying a layer of a first photoresist material having a first thickness to the device surface side of the chip;

patterning and developing the first photoresist material to provide at least one ink via location therein and to planarize the device surface side of the chip;

applying a layer of a second photoresist material having a second thickness to the ink surface side of the chip to provide a masking layer of photoresist material on the ink surface side of the chip;

patterning and developing the second photoresist material to define the at least one ink via location in the second photoresist material on the ink surface side of the chip;

applying a layer of a third photoresist material to the first photoresist material and device surface side of the chip;

patterning and developing the third photoresist material to provide the at least one ink via location therein on the device surface side of the chip;

anisotropically etching a first trench from the device surface side of the chip to a first depth and a first width using a first dry etch technique, the first trench being etched in the ink via location;

applying an etch stop material in first trench and to first photoresist material or to the first and third photoresist material on the device surface side of the chip to provide an etch stop layer;

anisotropically etching a second trench from the ink surface side of the chip up to the etch stop layer using a second dry etch technique, the second trench having a second width and being etched in substantially the same ink via location provided in the second photoresist material on the ink surface side of the chip; and removing the second photoresist material from the ink surface side of the chip; and removing the etch stop material from the device surface side of the chip to provide a chip having at least one ink via therein.

An advantage of the invention is that one or more ink via holes may be formed in a semiconductor silicon chip which meet demanding tolerances and provide improved ink flow to one or more heater resistors. Unlike grit blasting techniques, the ink vias are formed without introducing unwanted stresses or microscopic cracks in the semiconductor chips. Grit blasting is not readily adaptable to forming relatively narrow ink vias because the tolerances for grit blasting are too large or to forming a large number of individual ink vias in a semiconductor chip because each via must be bored one at a time. Deep reactive ion etching (DRIE) and inductively coupled plasma (ICP) etching, referred to herein as "anisotropically etching" or "dry etching", also provide advantages over wet chemical etching techniques because the etch rate is not dependent on silicon thickness or crystal orientation. Dry etching techniques are also adaptable to producing a larger number of ink vias which may be more closely spaced to corresponding heater resistors than ink vias made with conventional wet chemical etching and grit blasting processes.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
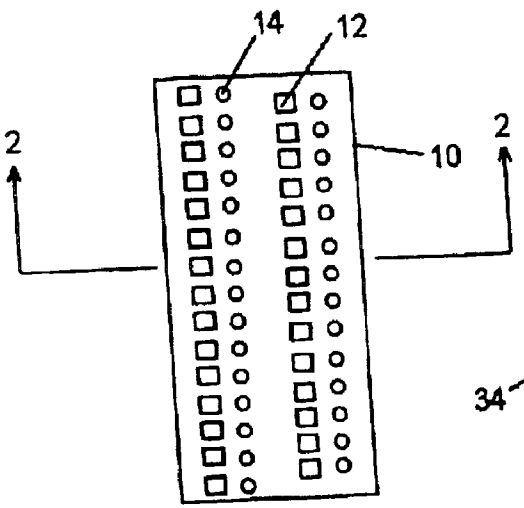
FIG. 1 is a top plan view of a portion of a semiconductor chip showing the arrangement of ink vias and heater resistors according to one aspect of the invention.

With reference to FIG. 1, the invention provides a semiconductor silicon chip 10 having a device side containing a plurality of heater resistors 12 and a plurality of ink feed vias 14 therein corresponding to one or more of the heater resistors 12. The semiconductor chips 10 are relatively small in size and typically have overall dimensions ranging from about 2 to about 10 millimeters wide by about 10 to about 36 millimeters long. In conventional semiconductor chips containing slot-type ink vias which are grit blasted in the chips 10, the ink via slots have dimensions of about 9.7 millimeters long and 0.39 millimeters wide, although the ranges may vary. Accordingly, the chips 10 must have a width sufficient to contain the relatively wide ink via while considering manufacturing tolerances, and sufficient surface area for heater resistors and connectors. In the chips made according to the invention, the ink via holes 14 or elongate slots have a diameter or width ranging from about 5 microns to about 800 microns with tighter tolerances than conventionally made ink vias of the same size thereby substantially reducing the amount of chip surface area required for the ink vias, heater resistors and connecting circuits. An ink via provided by an elongate slot may have a slot length ranging from about 12 millimeters to about 30 millimeters or more depending on the heater chip length. Reducing the width of the chips 10 enables a substantial increase in the number of chips 10 that may be obtained from a single silicon wafer. Hence, the invention provides substantial incremental cost savings over chips made by conventional grit blasting or wet chemical etching techniques containing slot type ink vias due to a reduction in the chip area required for the ink vias.

The ink feed vias 14 are etched through the entire thickness of the semiconductor substrate 32 and are in fluid communication with ink supplied from an ink supply container, ink cartridge or remote ink supply. The ink vias 14 direct ink from the ink supply container which is located opposite the device layer 34 side of the silicon chip 10 through the substrate 32 to the device layer 34 side of the chip 10 as seen in the plan view in FIG. 1 and perspective view in FIG. 3. The device side of the chip 10 also preferably contains electrical tracing from the heater resistors to contact pads used for connecting the chip to a flexible circuit or TAB circuit for supplying electrical impulses from a printer controller to activate one or more heater resistors 12.

Figure 1A:
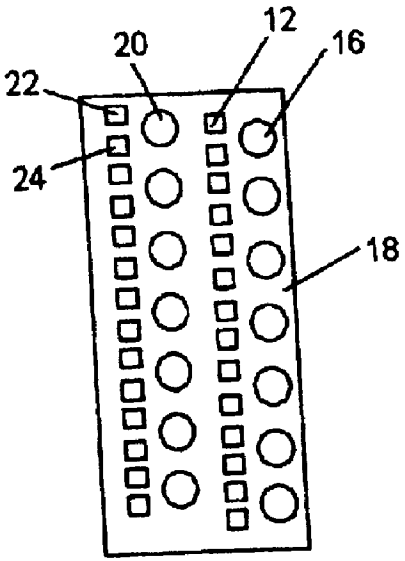
FIG. 1A is a top plan view of a portion of a semiconductor chip showing an alternate arrangement of ink vias and heater resistors according to the invention.

In FIG. 1, a single ink via 14 is associated with a single heater resistor 12. Accordingly, there are as many ink vias 14 as heater resistors 12 on the chip 10. An alternative arrangement of ink vias 14 and heater resistors 12 is shown in FIG. 1A. In this example, ink vias 16 are substantially larger than the ink vias 14 of FIG. 1. Each ink via 16 of chip 18 in FIG. 1A is associated with two or more heater resistors 12. For example, ink via 20 is associated with heater resistors 22 and 24. In yet another embodiment, there is one ink via for feeding ink to four or more adjacent heater resistors 12.

Figure 2:
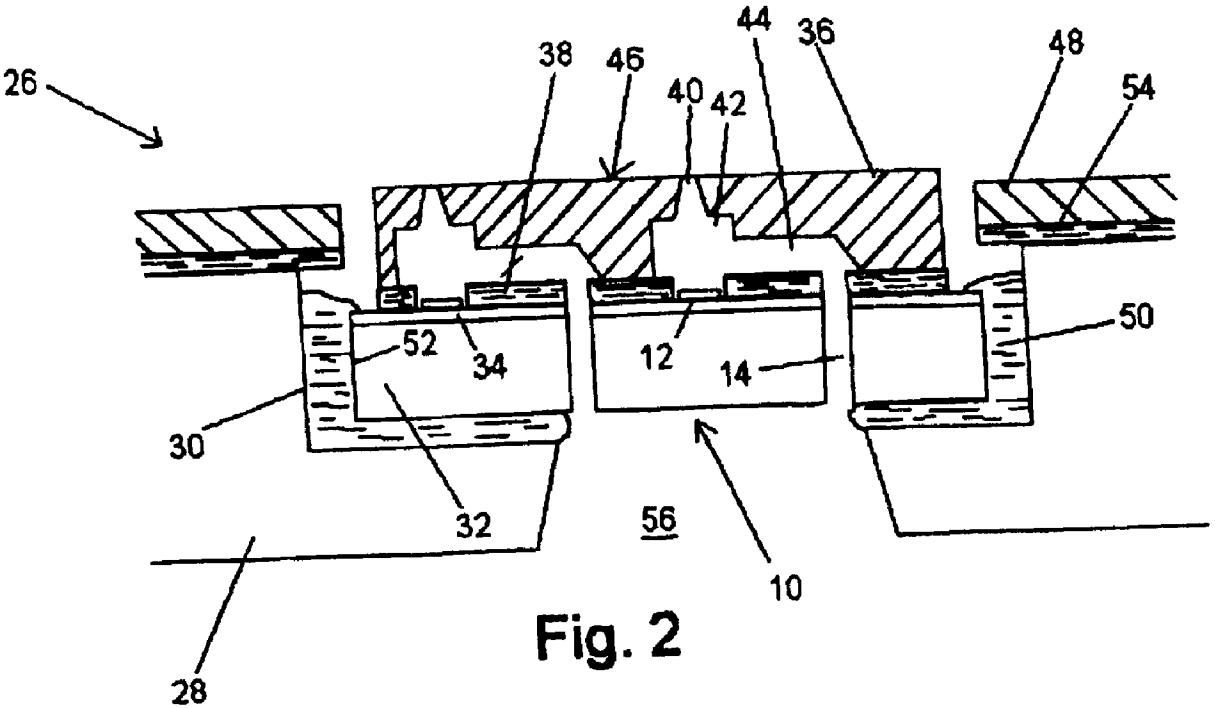
FIG. 2 is a cross-sectional view, not to scale of a portion of a printhead for an ink jet printer.

A cross-sectional view, not to scale of a portion of a printhead 26 containing the semiconductor silicon chip 10 of FIGS. 1 or 1A is illustrated in FIG. 2. As seen in FIG. 2, the printhead includes a chip carrier or cartridge body 28 having a recess or chip pocket 30 therein for attachment of a silicon chip 10 (FIG. 1) thereto, the chip having a substrate layer 32 and a device layer 34. The heater resistors 12 are formed on the device layer 34 by well known semiconductor manufacturing techniques.

After depositing resistive, conductive, insulative and protective layers on device layer 34 and forming ink vias 14, a nozzle plate 36 is attached to the device layer 34 side of the chip 10 by means of one or more adhesives such as adhesive 38 which may be a UV-curable or heat curable epoxy material. Adhesive 38 is preferably a heat curable adhesive such as a B-stageable thermal cure resin, including, but not limited to phenolic resins, resorcinol resins, epoxy resins, ethylene-urea resins, furane resins, polyurethane resins and silicone resins. The adhesive 38 is preferably cured before attaching the chip 10 to the chip carrier or cartridge body 28 and adhesive 38 preferably has a thickness ranging from about 1 to about 25 microns. A particularly preferred adhesive 38 is a phenolic butyral adhesive which is cured by heat and pressure.

The nozzle plate 36 contains a plurality of nozzle holes 40 each of which are in fluid flow communication with an ink chamber 42 and an ink supply channel 44 which are formed in the nozzle plate material by means such as laser ablation. A preferred nozzle plate material is polyimide which may contain an ink repellent coating on surface 46 thereof. Alternatively ink supply channels may be formed independently of the nozzle plate in a layer of photoresist material applied and patterned by methods known to those skilled in the art.

The nozzle plate 36 and semiconductor chip 10 are preferably aligned optically so that the nozzle holes 40 in the nozzle plate 36 align with heater resistors 12 on the semiconductor chip 10. Misalignment between the nozzle holes 40 and the heater resistor 12 may cause problems such as misdirection of ink droplets from the printhead 26, inadequate droplet volume or insufficient droplet velocity. Accordingly, nozzle plate/chip assembly 36/10 alignment is critical to the proper functioning of an ink jet printhead. As seen in FIG. 2, the ink vias 14 are also preferably aligned with the ink channels 44 so that ink is in flow communication with the ink vias 14, channels 44 and ink chambers 42.

After attaching the nozzle plate 36 to the chip 10, the semiconductor chip 10 of the nozzle plate/chip assembly 36/10 is electrically connected to the flexible circuit or TAB circuit 48 using a TAB bonder or wires to connect traces on the flexible or TAB circuit 48 with connection pads on the semiconductor chip 10. Subsequent to curing adhesive 38, the nozzle plate/chip assembly 36/10 is attached to the chip carrier or cartridge body 28 using a die bond adhesive 50. The nozzle plate/chip assembly 36/10 is preferably attached to the chip carrier or cartridge body 28 in the chip pocket 30. Adhesive 50 seals around the edges 52 of the semiconductor chip 10 to provide a substantially liquid tight seal to inhibit ink from flowing between edges 52 of the chip 10 and the chip pocket 30.

The die bond adhesive 50 used to attach the nozzle plate/chip assembly 36/10 to the chip carrier or cartridge body 28 is preferably an epoxy adhesive such as a die bond adhesive available from Emerson & Cuming of Monroe Township, N.J. under the trade name ECCOBOND 3193-17. In the case of a thermally conductive chip carrier or cartridge body 28, the die bond adhesive 50 is preferably a resin filled with thermal conductivity enhancers such as silver or boron nitride. A suitable thermally conductive die bond adhesive 50 is POLY-SOLDER LT available from Alpha Metals of Cranston, R.I. A preferred die bond adhesive 50 containing boron nitride fillers is available from Bryte Technologies of San Jose, Calif. under the trade designation G0063. The thickness of adhesive 50 preferably ranges from about 25 microns to about 125 microns. Heat is typically required to cure adhesive 50 and fixedly attach the nozzle plate/chip assembly 36/10 to the chip carrier or cartridge body 28.

Once the nozzle plate/chip assembly 36/10 is attached to the chip carrier or cartridge body 28, the flexible circuit or TAB circuit 48 is attached to the chip carrier or cartridge body 28 using a heat activated or pressure sensitive adhesive 54. Preferred pressure sensitive adhesives 54 include, but are not limited to, acrylic based pressure sensitive adhesives such as VHB Transfer Tape 9460 available from 3M Corporation of St. Paul, Minn. The adhesive 54 preferably has a thickness ranging from about 25 to about 200 microns.

In order to control the ejection of ink from the nozzle holes 40, each semiconductor chip 10 is electrically connected to a print controller in the printer to which the printhead 10 is attached. Connections between the print controller and the heater resistors 12 of printhead 10 are provided by electrical traces which terminate in contact pads in the device layer 34 of the chip 10. Electrical TAB bond or wire bond connections are made between the flexible circuit or TAB circuit 48 and the contact pads on the semiconductor substrate 10.

During a printing operation, an electrical signal is provided from the printer controller to activate one or more of the heater resistors 12 thereby heating ink in the ink chamber 42 to vaporize a component of the ink thereby forcing ink through nozzle 40 toward a print media. Ink is caused to refill the ink channel 44 and ink chamber 42 by collapse of the bubble in the ink and capillary action. The ink flows from an ink supply container through an ink feed slot 56 in the chip carrier or cartridge body 28 to the ink feed vias 14 in the chip 10. It will be appreciated that the ink vias 14 made by the methods of the invention as opposed to vias 14 made by grit blasting techniques, provide chips 10 having greater structural integrity and greater placement accuracy. In order to provide chips 10 having greater structural integrity, it is important to form the vias 14 with minimum damage to the semiconductor chip 10.

A preferred method for forming ink vias 14 in a silicon semiconductor substrate 32 is a dry etch technique selected from deep reactive ion etching (DRIE) and inductively coupled plasma (ICP) etching. Both techniques employ an etching plasma comprising an etching gas derived from fluorine compounds such as sulfur hexafluoride ($SF_6$), tetrafluoromethane ($CF_4$) and trifluoroamine ($NF_3$). A particularly preferred etching gas is $SF_6$. A passivating gas is also used during the etching process. The passivating gas is derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof. A particularly preferred passivating gas is $C_4F_8$.

In order to conduct dry etching of vias 14 in the silicon semiconductor substrate 32, the device layer 34 of the chip 10 is preferably coated with an etch stop material selected from $SiO_2$, a positive or negative photoresist material, etch resistant polymeric materials, etch resistant polymeric films or tapes, metal and metal oxides, i.e., tantalum, tantalum oxide, titanium dioxide and the like. The application and use of an etch stop material during the ink via 14 fabrication process will be described in more detail below.

The device layer 34 of the chip is relatively thin compared to the thickness of the substrate layer 32 and will generally have a substrate layer 32 to device layer 34 thickness ratio ranging from about 125:1 to about 800:1. Accordingly, for a silicon substrate layer 32 having a thickness ranging from 300 to about 800 microns, the device layer 34 thickness may range from about 1 to about 4 microns.

The ink vias 14 in the chip 10 may be etched in the substrate 32 from either side of the substrate 32 or from both sides of the substrate 32. An etch stop material is preferably provided on one side of the substrate 32 during the etching process. When a positive or negative photoresist material is used to define the ink via locations on the chip surface for forming ink vias 14 in the substrate 32, the photoresist material is patterned using, for example, ultraviolet light and a photomask. After patterning, the photoresist material is then developed to provide openings in the photoresist material corresponding to the ink via locations.

Figure 3:
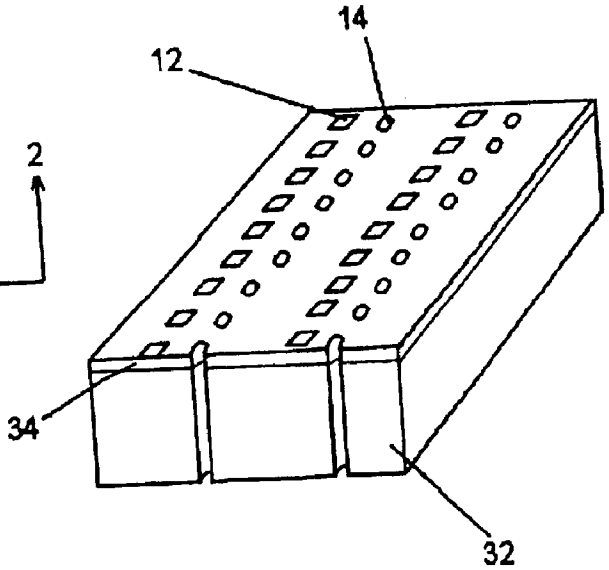
FIG. 3 is a cut away perspective view of a portion of a semiconductor chip according to a first aspect of the invention.

The via 14 locations in the chip 10 of FIG. 3 may also be patterned using a two-step process. In the first step, a relative shallow trench is etched in the substrate 32 in the via 14 locations by etching the device layer 34 and substrate 32 with a dry etching technique (or during wafer fabrication). The via 14 trenches are preferably etched to a depth, of about 50 microns. The device layer 34 of the chip 10 and the trench are then coated with an etch stop material and the substrate 32 is dry etched from the side opposite the device layer 34 side to complete the via 14 through the chip up to the etch stop layer. As a result of the two-step process, the via locations and sizes are even more precise.

In order to etch completely through the thickness of the silicon substrate 32, an anisotropic etching process is preferably used. The most preferred anisotropic etching process is a dry etching process known as a deep reactive ion etch (DRIE) or inductively coupled plasma (ICP) etch of the silicon which is conducted using an etching plasma derived from $SF_6$ and a passivating plasma derived from $C_4F_8$. The patterned chip 10 containing the etch stop layer applied to the device layer 34 and a masking layer on the surface opposite the device layer 34 is then placed in an etch chamber having a source of plasma gas and back side cooling such as with helium and water. It is preferred to maintain the silicon chip 10 below about 400° C., most preferably in a range of from about 50° to about 80° C. during the etching process. In the above described process, the substrate 32 is etched from the side opposite the device layer 34 toward the device layer 34 side.

During the etching process, the plasma is cycled between the passivating plasma step and the etching plasma step until the vias 14 reach the etch stop material applied to the device layer 34. Cycling times for the etching and passivation steps preferably ranges from about 5 to about 20 seconds for each step. Gas pressure in the etching chamber preferably ranges from about 15 to about 50 millitorrs at a temperature ranging from about −20° to about 35° C. The DRIE or ICP platen power preferably ranges from about 10 to about 25 watts and the coil power preferably ranges from about 800 watts to about 3.5 kilowatts at frequencies ranging from about 10 to about 15 MHz. Etch rates may range from about 2 to about 20 microns per minute or more and produce holes having side wall profile angles ranging from about 88° to about 94°. Etching apparatus is available from Surface Technology Systems, Ltd. of Gwent, Wales. Procedures and equipment for etching silicon are described in European Application No. 838,839A2 to Bhardwaj, et al., U.S. Pat. No. 6,051,503 to Bhardwaj, et al., PCT application WO 00/26956 to Bhardwaj, et al.

When the etch stop layer is reached, etching of the vias 14 terminates. The etch stop layer may then be removed to provide fluid communication between the device layer 34 and the ink vias 14 in substrate 32. The finished chip 10 preferably contains vias 14 which are located in the chip 10 so that vias 14 are a distance ranging from about 40 to about 60 microns from their respective heaters 12 on device layer 34. The ink vias 14 may be individually associated with each heater resistor 12 on the chip 10 or there may be more or fewer ink vias 14 than heater resistors 12. In such case, each ink via 14 will provide ink to a group of heater resistors 12. In a particularly preferred embodiment, ink vias 14 are individual holes or apertures, each hole or aperture being adjacent a corresponding heater resistor 12. Each ink via 14 has a diameter ranging from about 5 to about 200 microns.

Figure 4:
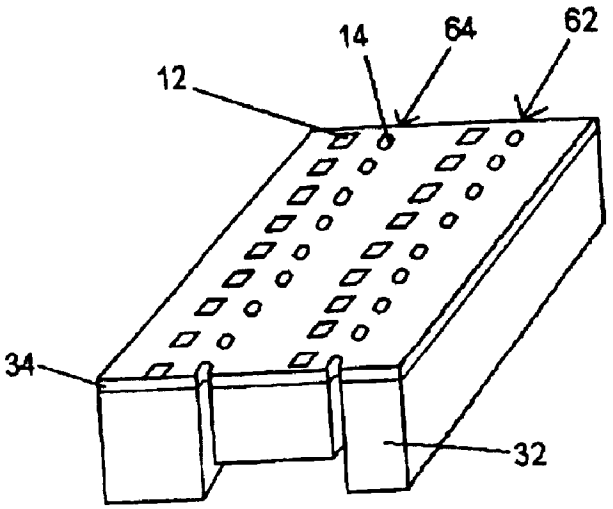
FIG. 4 is a cut away perspective view of a portion of a semiconductor chip according to a second aspect of the invention.

In another embodiment, as shown in FIG. 4, a wide trench 60 may be formed from the back side in the substrate 32 by chemically etching the silicon substrate prior to or subsequent to forming vias 14 in the substrate 32. Chemical etching of trench 60 may be conducted using KOH, hydrazine, ethylenediamine-pyrocatechol-$H_2O$ (EDP) or tetramethylammonium hydroxide (TMAH) and conventional chemical etching techniques. Prior to or subsequent to forming trench 60, vias 14 are etched in the substrate 32 from the device layer 34 side or from the side opposite the device layer 34 as described above. Trench 60 may also be formed by reactive ion (RIE), DRIE or ICP etching of the substrate 32 as described above. When the trench 60 is made by chemical etching techniques, a silicon nitride (SiN) protective layer or other hard mask layer is preferably applied to the surface of the chip opposite the device layer 34 and is used to pattern the trench location in the substrate 32. Upon completion of the trench formation, a masking layer or other protective material for dry etching silicon is applied to the substrate 32 to protect the silicon material during the dry etch process as described above.

The trench 60 is preferably provided in substrate 32 to a depth of about 50 to about 500 microns or more. The trench 60 should be wide enough to fluidly connect all of the vias 14 in the chip to one another, or separate parallel trenches 60 may be used to connect parallel rows of vias 14 to one another such as a trench for via row 62 and a trench for via row 64.

Figure 7:
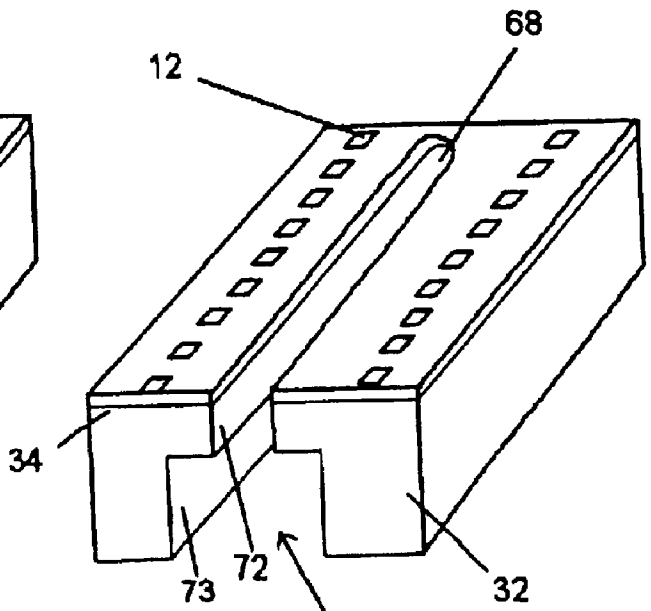
FIG. 7 is a cut away perspective view of a portion of a semiconductor chip according to a fourth aspect of the invention.
Figure 6:
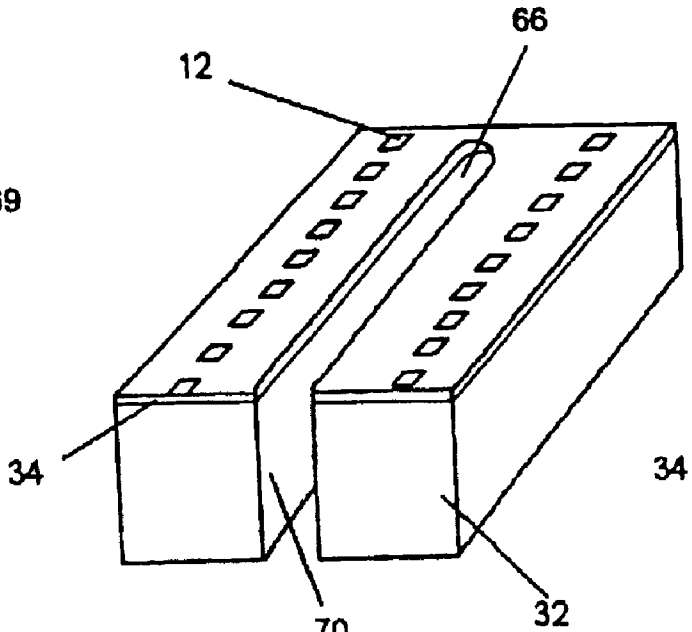
FIG. 6 is a cut away perspective view of a portion of a semiconductor chip according to the third aspect of the invention.
Figure 5:
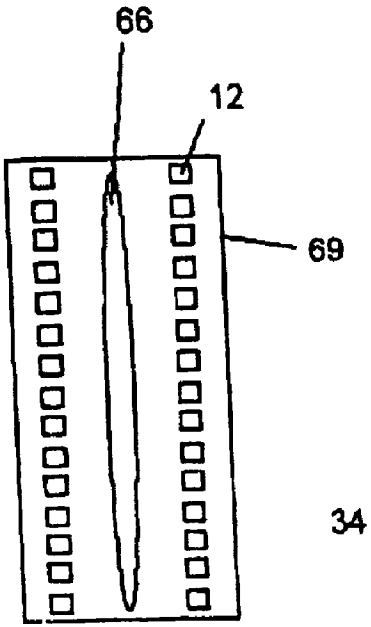
FIG. 5 is a top plan view of a portion of a semiconductor chip according to a third aspect of the invention.

Additional aspects of the invention are illustrated in FIGS. 5–7. In these figures, the vias 66 and 68 are rectangular or oval shaped elongate slots which are adjacent multiple heater resistors 12 on chip 69. Slots are formed in the semiconductor substrate 32 as described above using DRIE techniques. The ink vias 66 and 68 have substantially vertical walls 70, 72, and 73, FIGS. 6 and 7 respectively, and may include a relatively wide trench 74 formed from the back side of the substrate 32 as described above with reference to FIG. 4.

Vias formed by conventional grit blasting techniques typically range from 2.5 mm to 30 mm long and 120 microns to 1 mm wide. The tolerance for grit blast vias is ±75 microns. By comparison, vias formed according to the invention may be made as small as 10 microns long and 10 microns wide. There is virtually no upper limit to the length via that may be formed by DRIE techniques. The tolerance for DRIE vias is about ±10 to about ±25 microns. Any shape via may be made using DRIE techniques according to the invention including round, square, rectangular and oval shaped vias. It is difficult if not impossible to form holes as small as 10 microns in relatively thick silicon chips using grit blasting or wet chemical etching techniques. Furthermore, the vias may be etched from either side of the chip 69 using DRIE techniques according to the invention. A large number of holes or vias 14 may be made at one time in a wafer containing many chips 10 rather than sequentially as with grit blasting techniques and at a much faster rate than with wet chemical etching techniques.

Chips 10 or 69 having vias 14, 66 or 68 formed by the foregoing dry etching techniques are substantially stronger than chips containing vias made by blasting techniques and do not exhibit cracks or fissures which can cause premature failure of printheads containing the chips. The accuracy of via placement is greatly improved by the foregoing process, providing about a 6 fold increase in via placement accuracy as compared to grit blast techniques.

As compared to wet chemical etching, the dry etching techniques according to the invention may be conducted independent of the crystal orientation of the silicon substrate 32 and thus may be placed more accurately in the chips 10. While wet chemical etching is suitable for chip thicknesses of less than about 200 microns, the etching accuracy is greatly diminished for chip thicknesses greater than about 200 microns. The gases used for DRIE techniques according to the invention are substantially inert whereas highly caustic chemicals are used for wet chemical etching techniques. The shape of the vias made by DRIE is essentially unlimited whereas the via shape made by wet chemical etching is dependent on crystal lattice orientation. For example in a (100) silicon chip, KOH will typically only etch squares and rectangles without using advance compensation techniques. The crystal lattice does not have to be aligned for DRIE techniques according to the invention.

A comparison of the strength of dry etched silicon chips made according to the invention and grit blasted silicon chips is contained in the following tables. In the following tables, multiple samples were prepared using grit blast and DRIE techniques to provide vias in silicon chips. The vias in each set of samples was intended to be approximately the same width and length on the device side and on the side opposite the device side. The "Avg. Edge of Chip to Via" measurements indicated in the tables are taken from the edge of the chip to the edge of the via taken along the length axis of the via. The "Avg. Via Width" measurements are taken at approximately the same point across each via along and parallel with the width axis of the via.

For the torsion test, a torsion tester was constructed having one end of the tester constructed with a rotating moment arm supported by a roller bearing. A slotted rod for holding the chip was connected to one end of the moment arm. The chip was held on its opposite end by a stationary slotted rod attached to the fixture. A TEFLON indenter was connected to the load cell in the test frame and used to contact the moment arm. A TEFLON indenter was used to reduce any added friction from the movement of the indenter down the moment arm as the arm rotated. The crosshead speed used was 0.2 inches per minute (5.08 mm/min.) and the center of the moment arm to the indenter was 2 inches (50.8 mm).

For the three-point bend test a modified three-point bend fixture was made. The rails and knife edges were polished smooth with a 3 micron diamond paste to prevent any surface defects of the fixture from causing a stress point on the chip samples. The rails of the tester had a span of 3.5 mm and the radius of the rails and knife edges used was about 1 mm. The samples were placed on the fixture and aligned visually with the ink via in the center of the lower support containing the rails and directly below the knife edge. The crosshead speed was 0.5 inches per minute (1.27 mm/min.) and all of the samples were loaded to failure.

TABLE 1

| Sample # | Avg. Via Width (mm) | Via Length (mm) | Avg. Edge of Chip to Via (mm) | Via type | Torsion Strength (lbs) |
|---|---|---|---|---|---|
| 1 | 0.5115 | 13.853 | 1.5455 | DRIE | 0.234 |
| 2 | 0.5075 | 13.863 | 1.5375 | DRIE | 0.301 |
| 3 | 0.4980 | 13.866 | 1.5383 | DRIE | 0.161 |
| 4 | 0.5162 | 13.867 | 1.5435 | DRIE | 0.249 |
| 5 | 0.5298 | 13.866 | 1.5400 | DRIE | 0.177 |
| 6 | 0.5237 | 13.906 | 1.5063 | DRIE | 0.354 |
| 7 | 0.5130 | 13.855 | 1.5455 | DRIE | 0.201 |
| 8 | 0.4978 | 13.855 | 1.5420 | DRIE | 0.288 |
| 9 | 0.5262 | 13.857 | 1.5410 | DRIE | 0.189 |
| 10 | 0.5240 | 13.883 | 1.5320 | DRIE | 0.211 |
| 11 | 0.5175 | 13.862 | 1.5430 | DRIE | 0.325 |

TABLE 1-continued

| Sample # | Avg. Via Width (mm) | Via Length (mm) | Avg. Edge of Chip to Via (mm) | Via type | Torsion Strength (lbs) |
|---|---|---|---|---|---|
| 12 | 0.5118 | 13.886 | 1.5327 | DRIE | 0.289 |
| 13 | 0.5115 | 13.876 | 1.5360 | DRIE | 0.178 |
| 14 | 0.5137 | 13.902 | 1.5265 | DRIE | 0.373 |
| 15 | 0.5225 | 13.915 | 1.5247 | DRIE | 0.270 |
| 16 | 0.5165 | 13.918 | 1.5775 | DRIE | 0.301 |
| 17 | 0.5188 | 13.867 | 1.5403 | DRIE | 0.271 |
| 18 | 0.5115 | 13.893 | 1.5368 | DRIE | 0.506 |
| 19 | 0.5153 | 13.876 | 1.5315 | DRIE | 0.276 |
| 20 | 0.5127 | 13.825 | 1.5308 | DRIE | 0.356 |
| Average Torsion Strength (lbs) for DRIE vias | | | | | 0.2755 |
| 21 | 0.5002 | 13.787 | 1.5470 | Grit blast | 0.139 |
| 22 | 0.4875 | 13.796 | 1.5642 | Grit blast | 0.199 |
| 23 | 0.4793 | 13.770 | 1.5843 | Grit blast | 0.142 |
| 24 | 0.5235 | 13.783 | 1.5605 | Grit blast | 0.233 |
| 25 | 0.4515 | 13.799 | 1.5367 | Grit blast | 0.185 |
| 26 | 0.4950 | 13.792 | 1.5740 | Grit blast | 0.146 |
| 27 | 0.4622 | 13.809 | 1.5290 | Grit blast | 0.210 |
| 28 | 0.4843 | 13.853 | 1.5447 | Grit blast | 0.179 |
| 29 | 0.4700 | 13.862 | 1.5388 | Grit blast | 0.067 |
| 30 | 0.4848 | 13.863 | 1.5397 | Grit blast | 0.177 |
| 31 | 0.4853 | 13.858 | 1.5297 | Grit blast | 0.220 |
| 32 | 0.4890 | 13.795 | 1.5720 | Grit blast | 0.261 |
| 33 | 0.4553 | 13.762 | 1.5848 | Grit blast | 0.172 |
| 34 | 0.4790 | 13.780 | 1.5775 | Grit blast | 0.244 |
| 35 | 0.4720 | 13.684 | 1.6140 | Grit blast | 0.231 |
| 36 | 0.4872 | 13.834 | 1.5497 | Grit blast | 0.292 |
| 37 | 0.4797 | 13.823 | 1.5302 | Grit blast | 0.161 |
| 38 | 0.5105 | 13.748 | 1.5957 | Grit blast | 0.245 |
| 39 | 0.4687 | 13.745 | 1.5860 | Grit blast | 0.292 |
| 40 | 0.4938 | 13.811 | 1.5525 | Grit blast | 0.124 |
| Average Torsion Strength (lbs) for Grit Blast vias | | | | | 0.1959 |

TABLE 2

| Sample # | Avg. Via Width (mm) | Via Length (mm) | Avg. Edge of Chip to Via (mm) | Via type | 3 Point Bond Strength (lbs) |
|---|---|---|---|---|---|
| 1 | 0.4977 | 13.840 | 1.5740 | DRIE | 22.59 |
| 2 | 0.5035 | 13.819 | 1.6817 | DRIE | 10.95 |
| 3 | 0.5022 | 13.832 | 1.6240 | DRIE | 23.55 |
| 4 | 0.5055 | 13.833 | 1.6630 | DRIE | 28.37 |
| 5 | 0.5035 | 13.833 | 1.6177 | DRIE | 25.85 |
| 6 | 0.5135 | 13.847 | 1.5498 | DRIE | 22.99 |
| 7 | 0.5107 | 13.853 | 1.5385 | DRIE | 22.07 |
| 8 | 0.4932 | 13.855 | 1.5447 | DRIE | 39.90 |
| 9 | 0.5030 | 13.869 | 1.5387 | DRIE | 21.11 |
| 10 | 0.5160 | 13.885 | 1.5280 | DRIE | 25.37 |
| 11 | 0.5245 | 13.855 | 1.5455 | DRIE | 22.39 |
| 12 | 0.5202 | 13.860 | 1.5463 | DRIE | 11.18 |
| 13 | 0.4982 | 13.860 | 1.5370 | DRIE | 24.62 |
| 14 | 0.5152 | 13.869 | 1.5330 | DRIE | 30.30 |
| 15 | 0.5250 | 13.859 | 1.5427 | DRIE | 30.78 |
| 16 | 0.5217 | 13.868 | 1.5363 | DRIE | 32.28 |
| 17 | 0.5240 | 13.851 | 1.5475 | DRIE | 22.22 |
| 18 | 0.4925 | 13.847 | 1.5505 | DRIE | 16.28 |
| 19 | 0.5142 | 13.869 | 1.5388 | DRIE | 17.96 |
| 20 | 0.5250 | 13.895 | 1.5275 | DRIE | 12.77 |
| Average 3 point bend strength (lbs) for DRIE vias | | | | | 23.18 |
| 21 | 0.4967 | 13.834 | 1.5425 | Grit blast | 2.698 |
| 22 | 0.4852 | 13.808 | 1.5475 | Grit blast | 5.808 |
| 23 | 0.4740 | 13.836 | 1.5477 | Grit blast | 4.246 |
| 24 | 0.4907 | 13.838 | 1.5472 | Grit blast | 5.511 |
| 25 | 0.4778 | 13.837 | 1.5500 | Grit blast | 6.556 |
| 26 | 0.4835 | 13.843 | 1.5670 | Grit blast | 4.909 |
| 27 | 0.4695 | 13.826 | 1.5535 | Grit blast | 8.352 |
| 28 | 0.4855 | 13.827 | 1.5548 | Grit blast | 5.288 |
| 29 | 0.4868 | 13.823 | 1.5582 | Grit blast | 4.754 |
| 30 | 0.4570 | 13.695 | 1.6208 | Grit blast | 5.120 |
| 31 | 0.4980 | 13.812 | 1.5618 | Grit blast | 6.358 |
| 32 | 0.4992 | 13.827 | 1.5473 | Grit blast | 4.737 |
| 33 | 0.4840 | 13.835 | 1.5477 | Grit blast | 4.172 |
| 34 | 0.4943 | 13.842 | 1.5490 | Grit blast | 4.139 |
| 35 | 0.4877 | 13.838 | 1.5268 | Grit blast | 5.852 |

TABLE 2-continued

| Sample # | Avg. Via Width (mm) | Via Length (mm) | Avg. Edge of Chip to Via (mm) | Via type | 3 Point Bond Strength (lbs) |
|---|---|---|---|---|---|
| 36 | 0.4890 | 13.810 | 1.5222 | Grit blast | 3.608 |
| 37 | 0.4882 | 13.825 | 1.5562 | Grit blast | 7.111 |
| 38 | 0.4795 | 13.815 | 1.5635 | Grit blast | 5.631 |
| 39 | 0.4855 | 13.811 | 1.5485 | Grit blast | 5.572 |
| 40 | 0.4855 | 13.827 | 1.5522 | Grit blast | 5.671 |
| | Average 3 point bend Strength (lbs) for Grit Blast vias | | | | 5.304 |

As seen in Table 1, silicon chips made with ink vias using the DRIE methods according to the invention exhibited higher torsional strength compared to similar sized vias made by grist blasting techniques. A more dramatic comparison of the strength between chips containing grit blast vias and chips containing DRIE vias is seen in Table 2. This table compares the 3 point bending strength of such chips. As seen by comparing the average strength of each type of chip, chips containing vias made by the DRIE technique exhibited more than about 4 times the strength of chips containing grit blast vias. The increased strength of vias made by DRIE techniques is significant.

Figure 9:
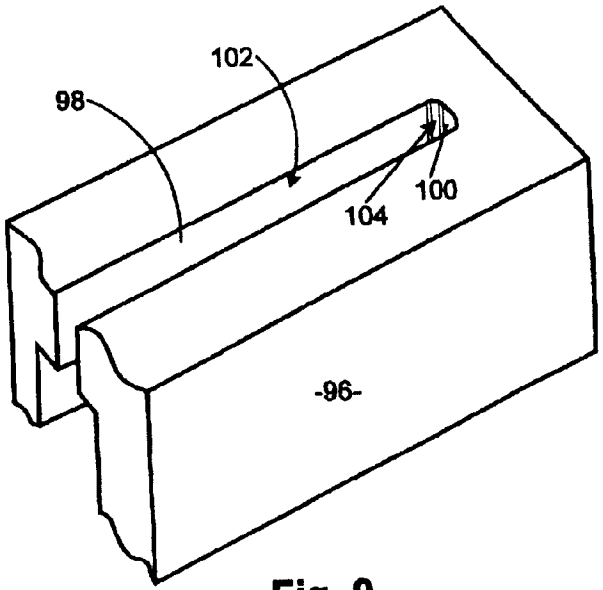
FIG. 9 is a partial perspective view, not to scale, of a heater chip according to another aspect of the invention.
Figure 8:
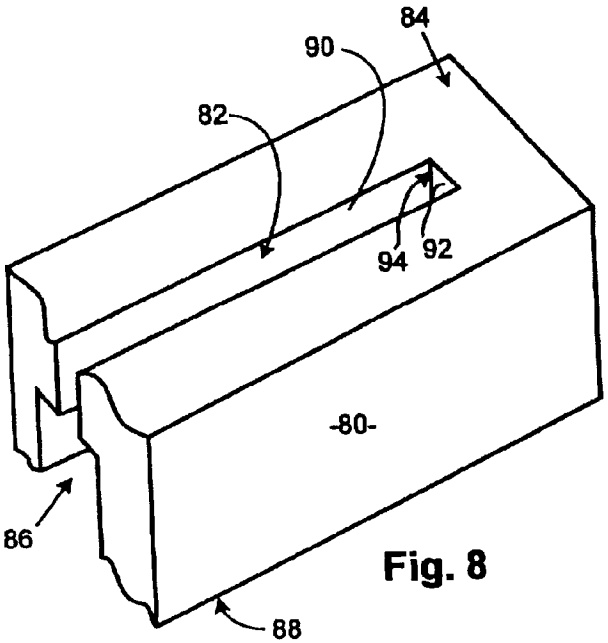
FIG. 8 is a partial perspective view, not to scale, of a heater chip according to an embodiment of the invention.
Figure 28:
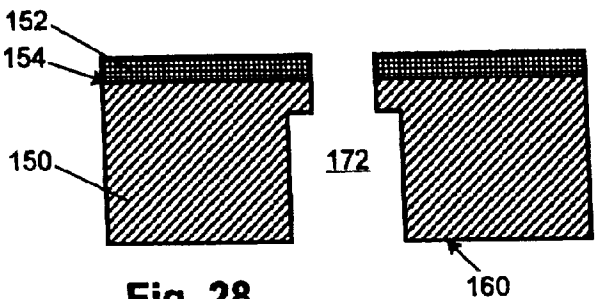
FIGS. 22–28 are cross-sectional views, not to scale, providing a process for making an ink jet heater chip according to another embodiment of the invention.

Another method for improving the strength of a silicon substrate used as a component of ink jet heater chip is illustrated in FIGS. 8 and 9. FIG. 8 is a silicon substrate 80 having a relatively narrow trench 82 formed from a device surface 84 of the substrate 80 part way through the substrate 80. A relatively wider trench 86 is formed in the substrate 80 from the ink surface side 88 of the substrate 80. The relatively narrow trench 82 has a plurality of side wall sections 90 and a plurality of end wall sections 92. In one embodiment, the side wall sections 90 intersect the end wall sections 92 at substantially ninety degrees to one another providing an area 94 which may be susceptible to microcracks which may propagate through the substrate 80 during use and handling of the chip thereby causing chip failure.

FIG. 9 provides an improved silicon substrate 96 which is less susceptible to forming microcracks where side wall sections 98 intersect end wall sections 100 of the ink via 102. According to this embodiment of the invention, a plurality of fillets 104 are provided adjacent the intersection of the side wall sections 98 with the end wall sections 100. The fillets 104 preferably include concavely curved sections in the longitudinal end portions of the via 102 as illustrated in FIG. 9. The radius of the concavely curved portions of the fillets 104 preferably ranges from about 0.25 to about 0.5 times the width of the ink via 102, most preferably about 0.5 times the width of the ink via 102. For example, a via 102 having a width of about 0.05 to about 0.5 millimeters will preferably have fillets 104 with a radius ranging from about 0.025 to about 0.25 millimeters. The optimum fillet radius is determined by the need for maximum via opening width with maximum stress reduction. The provision of ink vias 102 having fillet structures 104 advantageously enhances the strength of the vias 102 thereby reducing cracking or chipping in the via comers which is normally associated with right angle intersections 94 as shown in FIG. 8.

Figures 10, 11, 12, 13, 14, 15:
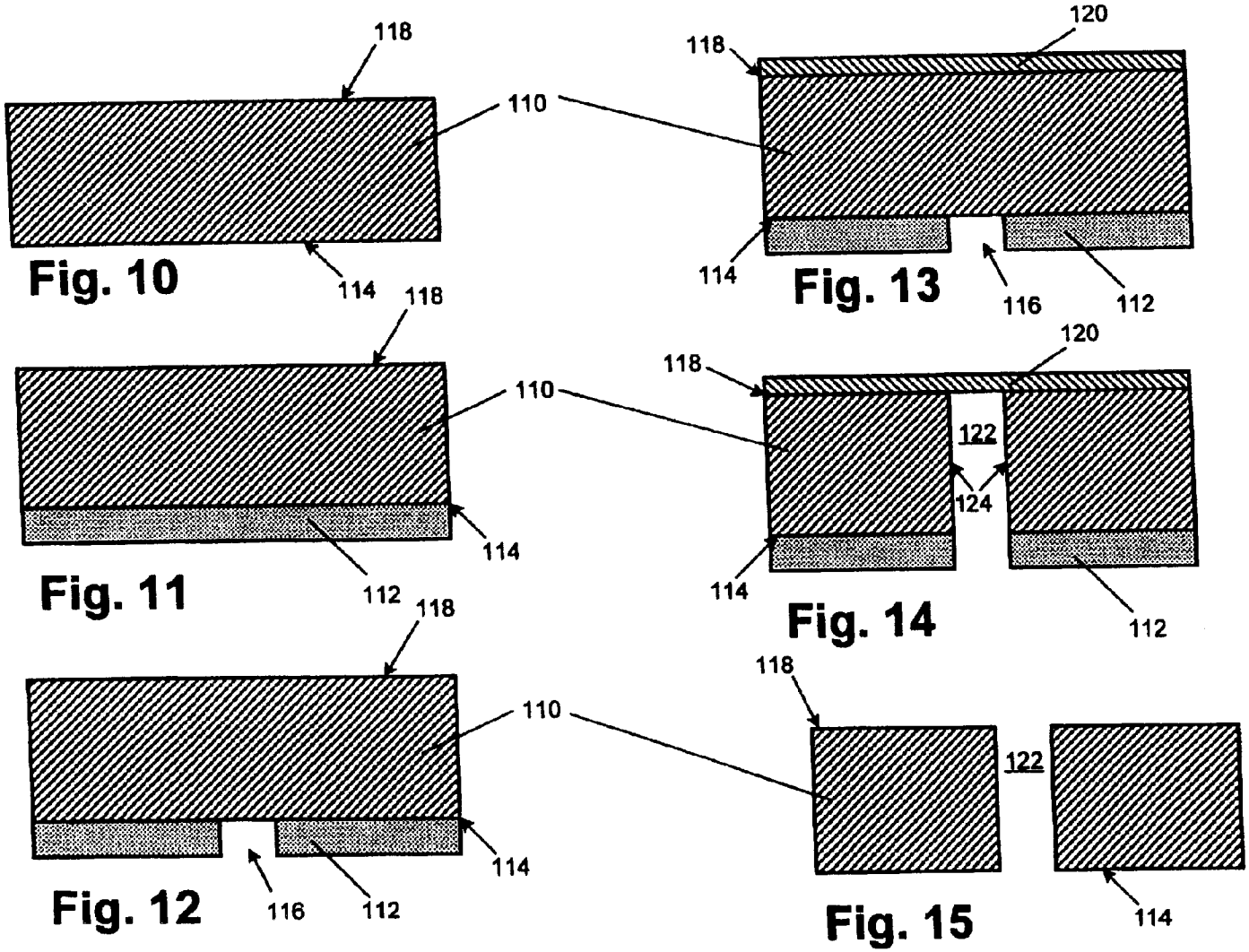
FIGS. 10–15 are cross-sectional views, not to scale, providing one process for making an ink jet heater chip according to the invention.

Now with reference to FIGS. 10–28, methods for forming ink vias according to the invention will be discussed in detail. With reference to FIGS. 10–15, a first method for forming an ink via in a silicon wafer 110 is provided. The silicon wafer preferably has an overall thickness ranging from about 300 to about 800 microns. (FIG. 10). Once the silicon wafer 110 has been sufficiently polished, a photoresist material 112 is applied to an ink surface side 114 of the wafer 110, FIG. 11. The photo resist material 112 may be a positive or negative photoresist material which may be coated onto or preferably spun onto the ink surface side 114 of the wafer 110. The thickness of the photoresist material 112 coated onto the wafer 110 preferably ranges from about 15 to about 35 microns, preferably about 25 microns and serves as a masking layer to protect areas of the wafer 110 which are not desired to be etched.

After coating the ink surface side 114 of the wafer with the photoresist material 112, the photoresist material is patterned and developed to provide the locations 116 of the ink vias, FIG. 12. The photoresist material 112 may be patterned and developed using a mask by conventional photoresist processing techniques.

Next, an etch stop material is applied to a device surface side 118 of the wafer 110 to provide an etch stop layer 120, FIG. 13. As set forth above, the etch stop material providing layer 120 may be selected from positive photoresist materials, negative photoresist materials, metal oxides such as silicon dioxide, titanium dioxide, tantalum oxide, and the like, and etch resistant polymeric films, tapes and coatings. In the case of positive or negative photoresist materials and polymeric coatings, the etch stop layer 120 may be formed by spin coating the device surface side 118 of the wafer 110. Removable films, such as a polyimide film or a polyester film, used as an etch stop layer 120 are bonded to the device surface side 118 of the wafer 110. Removable tapes used to provide the etch stop layer 120 may contain an adhesive thereon which looses its adhesive properties upon exposure to actinic radiation such as ultraviolet light. A preferred tape which is removable after exposure to ultraviolet light is available from Ultron Systems, Inc. of Moorpark, Calif. under the trade name ULTRON 1026R ultraviolet film.

After applying the etch stop layer 120 to the device surface side 118 of the wafer 110, the wafer is anisotropically etched using a dry etch technique such as DRIE or ICP as described above. Such technique enables formation of vias 122 having substantially vertical side walls 124 for the entire thickness of the silicon wafer 110, FIG. 14.

Upon completion of the via 122 formation in the wafer 110 up to the etch stop layer 120, the photoresist material 112 on the ink surface side 114 of the wafer 110 and the etch stop layer 120 on the device surface side 118 of the wafer 110 are removed to provide a wafer 110 having ink vias 122 therein. The etch stop materials may be removed by dissolving the materials in a suitable solvent. Positive photoresist materials may be removed, for example, by dissolving the etch stop layer 120 in butyl acetate or butyl cellosolve acetate or by using a combination of short oxygen reactive ion etch and butyl acetate solvent. Negative photoresist materials may be removed using either an oxygen reactive ion etch or by dissolving the photoresist material in hot n-methyl-2-pyrrolidone. Polymeric coating materials include, but are not limited to, polyvinyl alcohol, polyacrylamide, polyvinyl pyrrolidone, polyethylene oxide, and the like, and may be removed, for example by dissolving the material in water. Other polymeric coating materials which may be used include phenolic material coatings. When the etch stop material is provided by silicon dioxide, the silicon dioxide may be removed by reactive ion etching with sulfur hexafluoride or carbon tetrafluoride reactive gas, or by dipping the wafer 110 in hydrofluoric acid.

Figure 16:
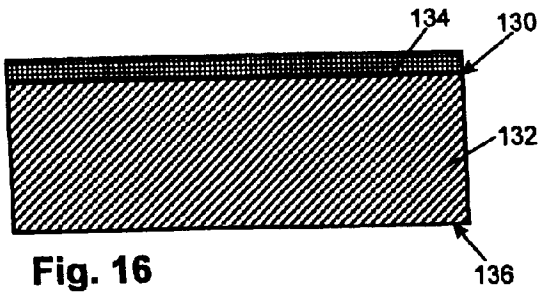
FIGS. 16–21 are cross-sectional view, not to scale, providing another process for making an ink jet heater chip according to the invention.

In an alternative process, a device surface side 130 of a silicon wafer 132 may include a planarizing layer or thick film layer 134 or both a planarizing layer and thick film layer 134, preferably formed from a positive or negative photoresist material. (FIG. 16). A planarizing layer preferably has a thickness ranging from about 1.5 to about 3.5 microns and a thick film layer preferably has a thickness ranging from about 20 to about 30 microns. Layer 134 may be provided by spin coating the device surface side 130 of the wafer with the photoresist material. Layer 134 is preferably applied to the wafer before applying a photoresist material to an ink surface side 136 of the wafer 132 and before applying an etch stop material to the device surface side 130 of the wafer. Layer 134 is patterned and developed to define the location 138 of at least one ink via on the device surface side 130 of the wafer 132, FIG. 17.

Figure 17:
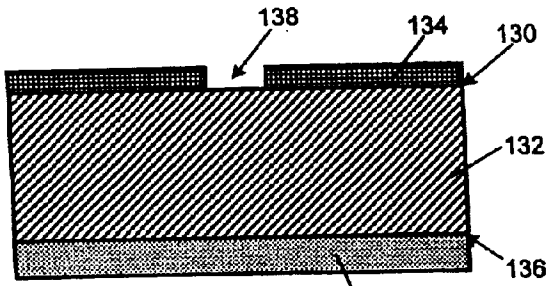
Figure 18:
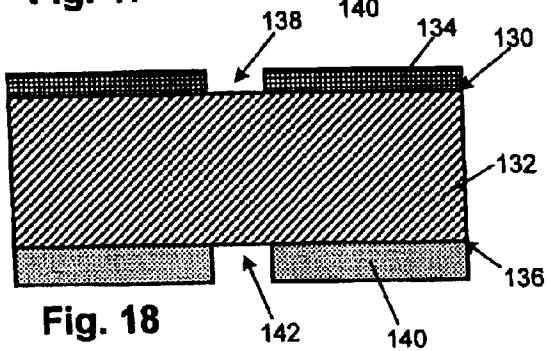

After applying the planarizing or thick film layer 134 to the wafer 132, a positive or negative photoresist material or other hard mask material such as silicon oxide or silicon nitride is applied to the ink surface side 136 of the wafer 132 to provide a masking layer 140, FIG. 17. The masking layer 140 is patterned and developed to define an ink via location 142 on the ink surface side 136 of the wafer substantially corresponding or aligned with the ink via location 138 on the device surface side 130 of the wafer, FIG. 18.

Figure 19:
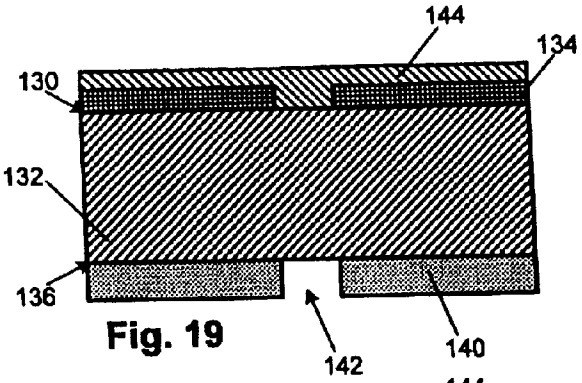
Figure 20:
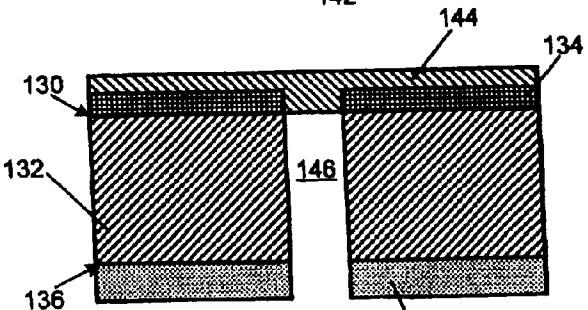
Figure 21:
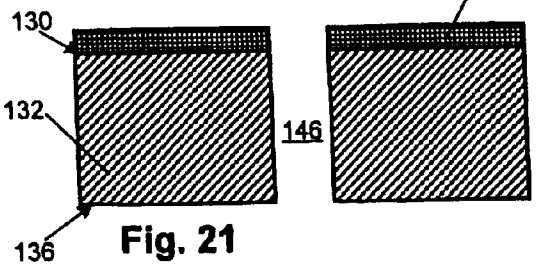

An etch stop material, as described above, is then applied to the device surface side 130 of the wafer 132 to protect the planarizing or thick film layer 134 and to provide an etch stop layer 144 which substantially fills the ink via location 138 in the layer 134, FIG. 19. The wafer may then be etched, as described above, to provide ink vias 146 which are formed through the thickness of the substrate 132 up to the etch stop layer 144, FIG. 20. Removal of the etch stop layer 144 and masking layer 140, as described above, provides a wafer containing ink vias 146 therein and planarizing or thick film layer 134 on the device surface side 130 thereof, FIG. 21.

The formation of wafers for ink jet heater chips having ink vias with a stepped width or variable width moving from one surface side of the wafer to another is described with reference to FIGS. 22-28. A wafer 110 or 132 as described above is provided for making multiple ink jet heater chips. For illustrative purposes, a wafer 150 containing a planarizing layer or thick film positive or negative photoresist layer 152 on a device layer side 154 is described.

Figure 22:
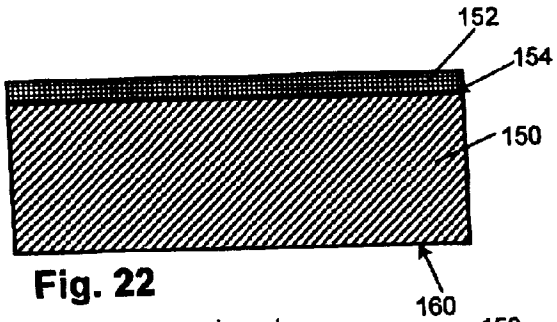
Figure 23:
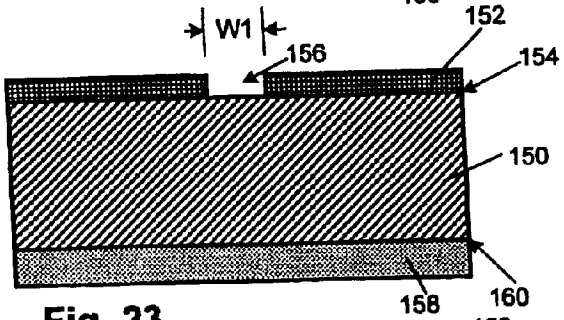
Figure 24:
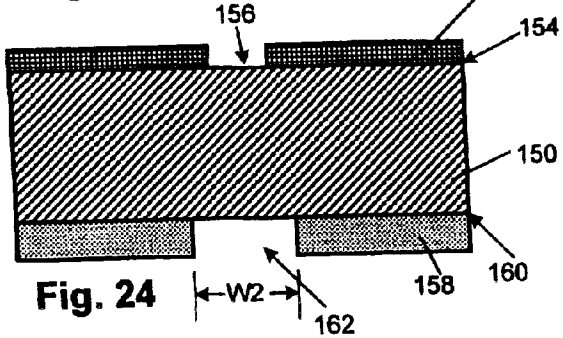

In FIG. 22, a planarizing layer 152 is applied to the device surface side of the wafer 150. The planarizing layer 152 is patterned and developed to provide ink via location 156 as described above with reference to FIG. 17, and to provide flow features therein, locations for heater resistors, and bond pad locations. In this case, the ink via location 156 is provided having a first width W1. A masking layer 158 is applied to the ink surface side 160 of the wafer (FIG. 23) as also described above. A third positive or negative photoresist material is spin coated onto the planarizing layer and device layer side 154 of the wafer 150 to provide a third photoresist layer 153 (FIG. 24). The thickness of the third photoresist layer 153 is not critical to the invention and thus may range from about 15 to about 35 microns or more. Ink via location 156 is patterned and etched in the third photoresist layer 153 using conventional photoresist etching techniques. FIG. 24 also illustrates a masking layer containing an ink via location 162 patterned in the masking layer 158 as described above with reference to FIG. 18. In this case, the ink via location 162 preferably has a second width W2 which is greater than the first width W1.

Figure 25:
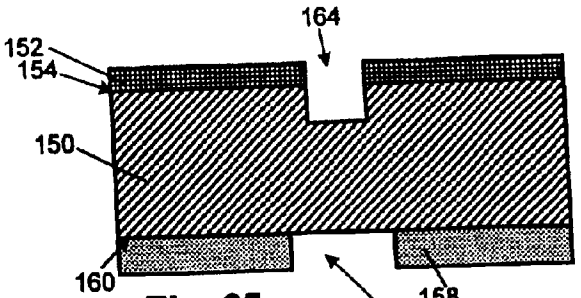
Figure 26:
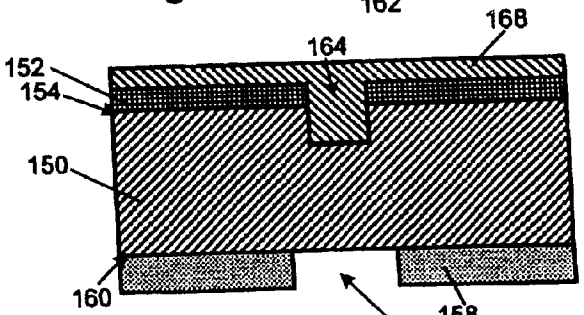
Figure 27:
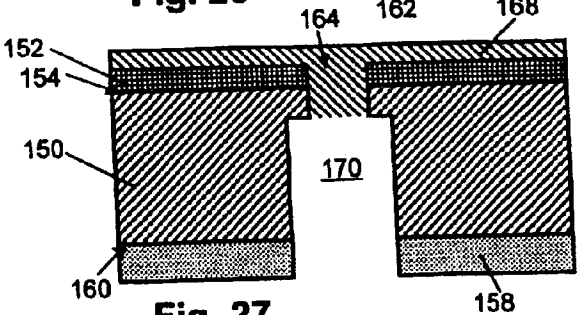

A relatively shallow first trench 164 is anisotropically etched in the silicon substrate 150 to a first depth using a dry etch technique such as reactive ion etching or deep reactive ion etching, FIG. 25. Next, an etch stop material is applied to the device surface side 154 of the wafer before or after removing the third photoresist layer 153 from the wafer to provide an etch stop layer 168. In a preferred embodiment, shown in FIG. 26, the etch stop material is applied to the device surface side 154 of wafer 150 after removing the third photoresist layer 153 by conventional techniques. The etch stop material preferably covers the planarizing layer 152 and effectively fills the first trench 164, FIG. 26.

The wafer 150 is then etched from the ink surface side 160 thereof using an anisotropic etch process such as DRIE as described above. The etching process provides a relatively wider second trench 170 which is etched through the remaining thickness of the silicon substrate 150 up to the etch stop layer 168 in first trench 164, FIG. 27. After removal of the etch stop material 168 and masking layer 158, a silicon wafer 150 containing ink vias 172 is provided, FIG. 28. It will be recognized that multiple chips are provided by a single wafer, each of the chips having one or more ink vias 122, 146 or 172 etched therein as described above.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method for making one or more ink feed vias in a semiconductor silicon substrate chip for an ink jet printhead, the chip having a thickness ranging from about 300 to about 800 microns and having a device surface side and an ink surface side opposite the device surface side, comprising the steps of:

applying a layer of a first photoresist material having a first thickness to the device surface side of the chip;

patterning and developing the first photoresist material to provide at least one ink via location therein and to planarize the device surface side of the chip;

applying a layer of a second photoresist material having a second thickness to the ink surface side of the chip to provide a masking layer of photoresist material on the ink surface side of the chip;

patterning and developing the second photoresist material to define the at least one ink via location in the second photoresist material on the ink surface side of the chip;

applying a layer of a third photoresist material to the first photoresist material and device surface side of the chip;

patterning and developing the third photoresist material to provide the at least one ink via location therein on the device surface side of the chip;

anisotropically etching a first trench from the device surface side of the chip to a first depth and a first width using a first dry etch technique, the first trench being etched in the ink via location;

applying an etch stop material in first trench and to first photoresist material or to the first and third photoresist material on the device surface side of the chip to provide an etch stop layer;

anisotropically etching a second trench from the ink surface side of the chip up to the etch stop layer using a second dry etch technique, the second trench having a second width and being etched in substantially the same ink via location provided in the second photoresist material on the ink surface side of the chip; and removing the second photoresist material from the ink surface side of the chip; and removing the etch stop material from the device surface side of the chip to provide a chip having at least one ink via therein.

2. The method of claim 1 comprising etching multiple ink vias in the chip.

3. The method of claim 1 wherein the ink via has a diameter or first width ranging from about 5 to about 800 microns.

4. The method of claim 1 wherein the first photoresist material is provided by one or more layers of photoresist material having an overall thickness ranging from about 2.5 to about 25 microns.

5. The method of claim 1 wherein the second dry etch technique is conducted while cycling between an etching plasma and a passivation plasma.

6. The method of claim 5 wherein the etching plasma comprises a plasma derived from a gas selected from the group consisting of sulfur hexafluoride ($SF_6$), tetrafluoromethane ($CF_4$) and trifluoroamine ($NF_3$).

7. The method of claim 5 wherein the passivation plasma comprises a plasma derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof.

8. The method of claim 1 wherein the second width is greater than the first width.

9. The method of claim 1 wherein the etch stop material is selected from the group consisting of positive photoresist materials, negative photoresist materials, metal oxides, and etch resistant polymeric films and tapes.

10. The method of claim 1 wherein the etch stop material is a polymeric material having etch resistant properties and the step of removing the etch stop layer comprises dissolving the etch stop material.

11. The method of claim 1 wherein the etch stop material is comprised of a photoresist material, and wherein the steps of removing the etch stop material and the second photoresist material on the ink surface side of the chip comprises a reactive ion etching process using oxygen as the reactive gas.

12. The method of claim 1 further comprising removing the layer of third photoresist material after anisotropically etching the first trench from the device surface side of the chip to the first depth and first width and prior to applying the etch stop material in the first trench and first photoresist material on the device surface side of the chip.

13. The method of claim 1 wherein the ink via comprises an elongate ink feed via, wherein the via is defined by a length a width and a depth, the ink via having a plurality of end wall sections and a plurality of side wall sections, further comprising forming a plurality of fillets, each of the fillets having a generally concavely curved section located at an angle formed by an intersection between one of the end wall sections and one of the side wall sections of the via.

14. The method of claim 13 wherein the concavely curved section of each of the fillets has a radius ranging from about 0.25 to about 0.5 times the width of the ink feed via.

15. An ink jet printhead comprising a nozzle plate attached the second surface side of a silicon chip having one or more ink vias therein made by the method of claim 13.

16. An ink jet printhead comprising a nozzle plate attached the second surface side of a silicon chip having one or more ink vias therein made by the method of claim 1.

17. A method for making one or more ink feed vias in a semiconductor silicon substrate for an ink jet printhead, the method consisting essentially of:

patterning and developing a photoresist material applied to a device surface side of a semiconductor substrate to define an trench location in the photoresist material on the device surface side of the substrate;

patterning and developing the a masking layer applied to an opposite surface side of the substrate to define at least one ink via location therein corresponding the trench location in the device side layer, wherein the substrate has a thickness ranging from about 300 to about 800 microns;

applying an etch stop material to the photoresist material and trench location on the device surface side of the substrate to provide an etch stop layer on the device surface side of the substrate;

anisotropically etching at least one ink via through the thickness of the silicon substrate up to the etch stop layer from the second surface side of the substrate using a dry etch technique whereby a via having substantially vertical side walls is provided through the thickness of the substrate;

removing the etch stop material on the device surface side of the substrate and removing the photoresist material on the second surface side of the substrate to provide a substrate having at least one ink via therethrough.

18. The method of claim 17 comprising etching multiple ink vias in the substrate.

19. The method of claim 17 wherein the ink via has a diameter, or width ranging from about 5 to about 800 microns.

20. The method of claim 17 wherein the photoresist material applied to the device surface side of the substrate comprises a layer selected from the group consisting of a planarizing layer having a thickness ranging from about 1.5 to about 3.5 microns, a thick film layer having a thickness ranging from about 20 to about 30 microns, and a combination of a planarizing layer and a thick film layer having an overall thickness ranging from about 21 to about 35 microns.

21. The method of claim 17 wherein the dry etch technique is conducted while cycling between an etching plasma and a passivation plasma.

22. The method of claim 21 wherein the etching plasma comprises a plasma derived from a gas selected from the group consisting of sulfur hexafluoride ($SF_6$), tetrafluoromethane ($CF_4$) and trifluoroamine ($NF_3$).

23. The method of claim 21 wherein the passivation plasma comprises a plasma derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof.

24. The method of claim 17 wherein the etch stop material is selected from the group consisting of positive photoresist materials, negative photoresist materials, metal oxides, and etch resistant polymeric films and tapes.

25. The method of claim 17 wherein the etch stop material is a polymeric material having etch resistant properties and the step of removing the etch stop layer comprises dissolving the etch stop material by chemical means.

26. The method of claim 17 wherein the ink via comprises an elongate ink feed via, wherein the via is defined by a length a width and a depth, the ink via having a plurality of end wall sections and a plurality of side wall sections, further comprising forming a plurality of fillets, each of the fillets having a generally concavely curved section located at an angle formed by an intersection between one of the end wall sections and one of the side wall sections of the via.

27. The method of claim 26 wherein the concavely curved section of each of the fillets has a radius ranging from about 0.25 to about 0.5 times the width of the ink feed via.

28. An ink jet printhead comprising a nozzle plate attached the second surface side of a silicon substrate having one or more ink vias therein made by the method of claim 26.

29. An ink jet printhead comprising a nozzle plate attached the second surface side of a silicon substrate having one or more ink vias therein made by the method of claim 17.

* * * * *